US008532527B2

(12) United States Patent
Takayama

(10) Patent No.: US 8,532,527 B2
(45) Date of Patent: Sep. 10, 2013

(54) IMAGE-FORMING APPARATUS

(75) Inventor: Seiichi Takayama, Ebina (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 177 days.

(21) Appl. No.: 12/785,202

(22) Filed: May 21, 2010

(65) Prior Publication Data

US 2011/0058848 A1 Mar. 10, 2011

(30) Foreign Application Priority Data

Sep. 10, 2009 (JP) ..... 2009-209365

(51) Int. Cl.
*G03G 15/00* (2006.01)

(52) U.S. Cl.
USPC ..... 399/117; 399/119

(58) Field of Classification Search
USPC ..... 399/107, 110, 111, 116, 117, 119, 399/159, 167, 222, 279
See application file for complete search history.

(56) References Cited

U.S. PATENT DOCUMENTS

| | | | | |
|---|---|---|---|---|
| 5,669,042 | A * | 9/1997 | Kobayashi et al. | 399/111 |
| 2004/0005407 | A1 * | 1/2004 | Takeuchi et al. | 427/240 |
| 2005/0191089 | A1 * | 9/2005 | Nishimura | 399/111 |

FOREIGN PATENT DOCUMENTS

| | | | |
|---|---|---|---|
| JP | 60170866 | A * | 9/1985 |
| JP | 07-114324 | A | 5/1995 |

* cited by examiner

*Primary Examiner* — Walter L Lindsay, Jr.
*Assistant Examiner* — Benjamin Schmitt
(74) *Attorney, Agent, or Firm* — Sughrue Mion, PLLC

(57) ABSTRACT

An image-forming apparatus includes an image-forming member assembly including a photosensitive member, a developing unit, and a rotating unit; a driving unit; a positioning member having a positioning hole in which a shaft of the photosensitive member is rotatably supported and positioned; and a support member having a support hole that has a guide side to guide a rotating shaft of the rotating unit and supports the rotating shaft in a direction toward and away from the positioning hole. When a force received by the rotating shaft while the driving unit drives the rotating unit is divided into a first component force along the guide side and a second component force orthogonal to the guide side, the first component force has a direction in which a contact force of the shaft of the photosensitive member against an edge of the positioning hole is increased.

11 Claims, 10 Drawing Sheets

IMAGE-FORMING APPARATUS

CROSS-REFERENCE TO RELATED APPLICATIONS

This application is based on and claims priority under 35 USC 119 from Japanese Patent Application No. 2009-209365 filed Sep. 10, 2009.

BACKGROUND (i) Technical Field

The present invention relates to an image-forming apparatus.

(ii) Related Art

An image-forming unit (image-forming member assembly) that is detachably attached to an apparatus body of an image-forming apparatus, such as a printer, is known. The image-forming unit includes a photosensitive drum (an example of a photosensitive member) and a developing roller (an example of a developing unit). The image-forming unit is used while being attached to the apparatus body of the image-forming apparatus.

SUMMARY

According to an aspect of the invention, there is provided an image-forming apparatus including an image-forming member assembly including a photosensitive member that has a shaft and allows an electrostatic latent image to be formed thereon, a developing unit that supplies the photosensitive member with a developer and develops the electrostatic latent image, and a rotating unit that has a rotating shaft, receives a driving force, and rotates the developing unit; a driving unit that drives the rotating unit; a positioning member having a positioning hole in which the shaft of the photosensitive member is rotatably supported and positioned at two points; and a support member having a support hole that has a guide side to guide the movement of the rotating shaft and supports the rotating shaft of the rotating unit in a direction in which the rotating shaft is moved toward and away from the positioning hole. When a force received by the rotating shaft while the driving unit drives the rotating unit is divided into a first component force along the guide side and a second component force orthogonal to the guide side, the first component force has a direction in which a contact force of the shaft of the photosensitive member against an edge of the positioning hole is increased.

BRIEF DESCRIPTION OF THE DRAWINGS

Exemplary embodiment(s) of the present invention will be described in detail based on the following figures, wherein.

DETAILED DESCRIPTION

Figure 1:
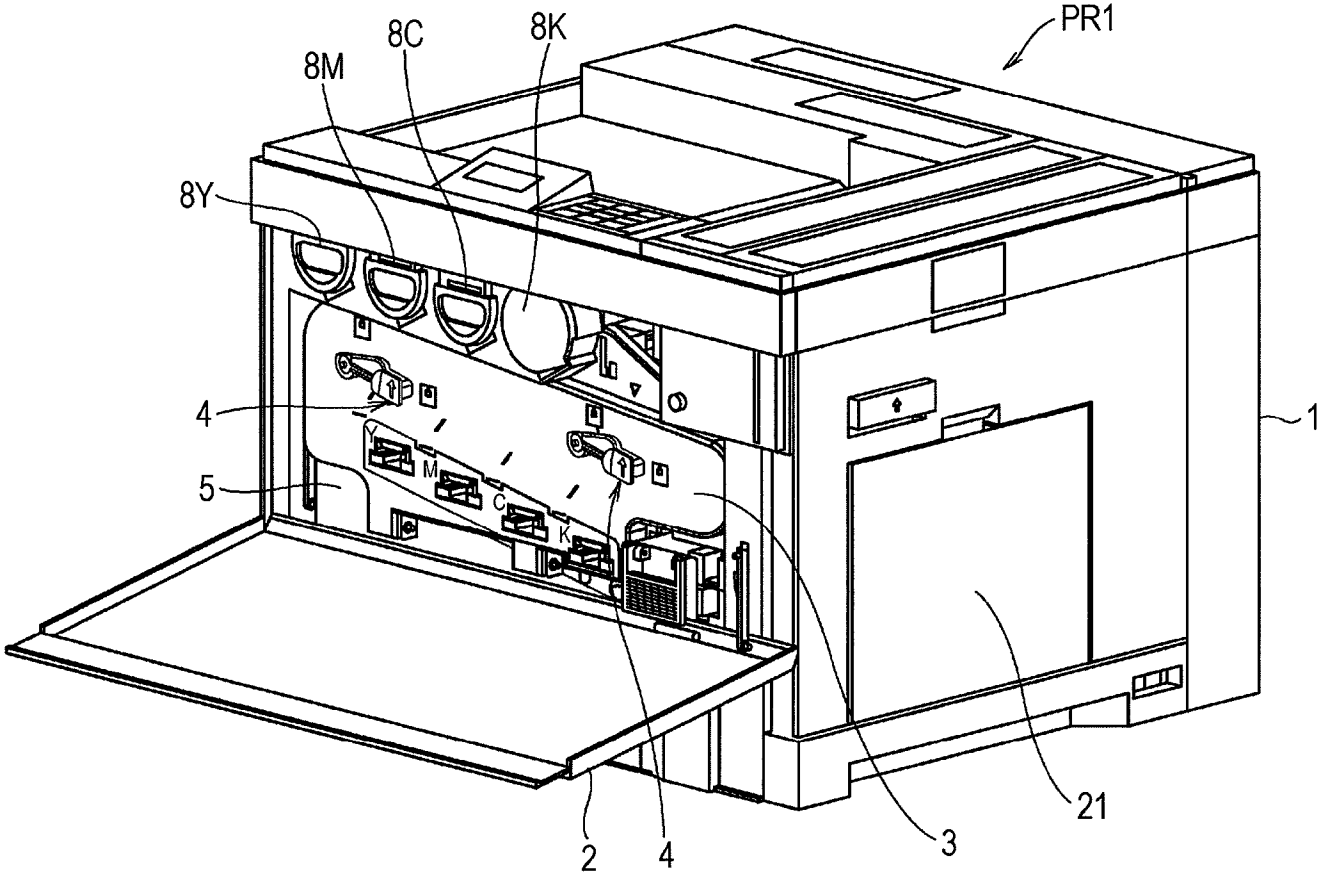
FIG. 1 is a perspective view of the appearance of a printer serving as an image-forming apparatus according to an exemplary embodiment of the present invention.

An exemplary embodiment as an example of the present invention will be described below in detail with reference to the drawings. In the drawings explaining the exemplary embodiment, like reference numerals basically refer like components and repeated explanation will be omitted.

A printer PR1 as an image-forming apparatus according to an exemplary embodiment of the present invention will be described.

Figure 2:
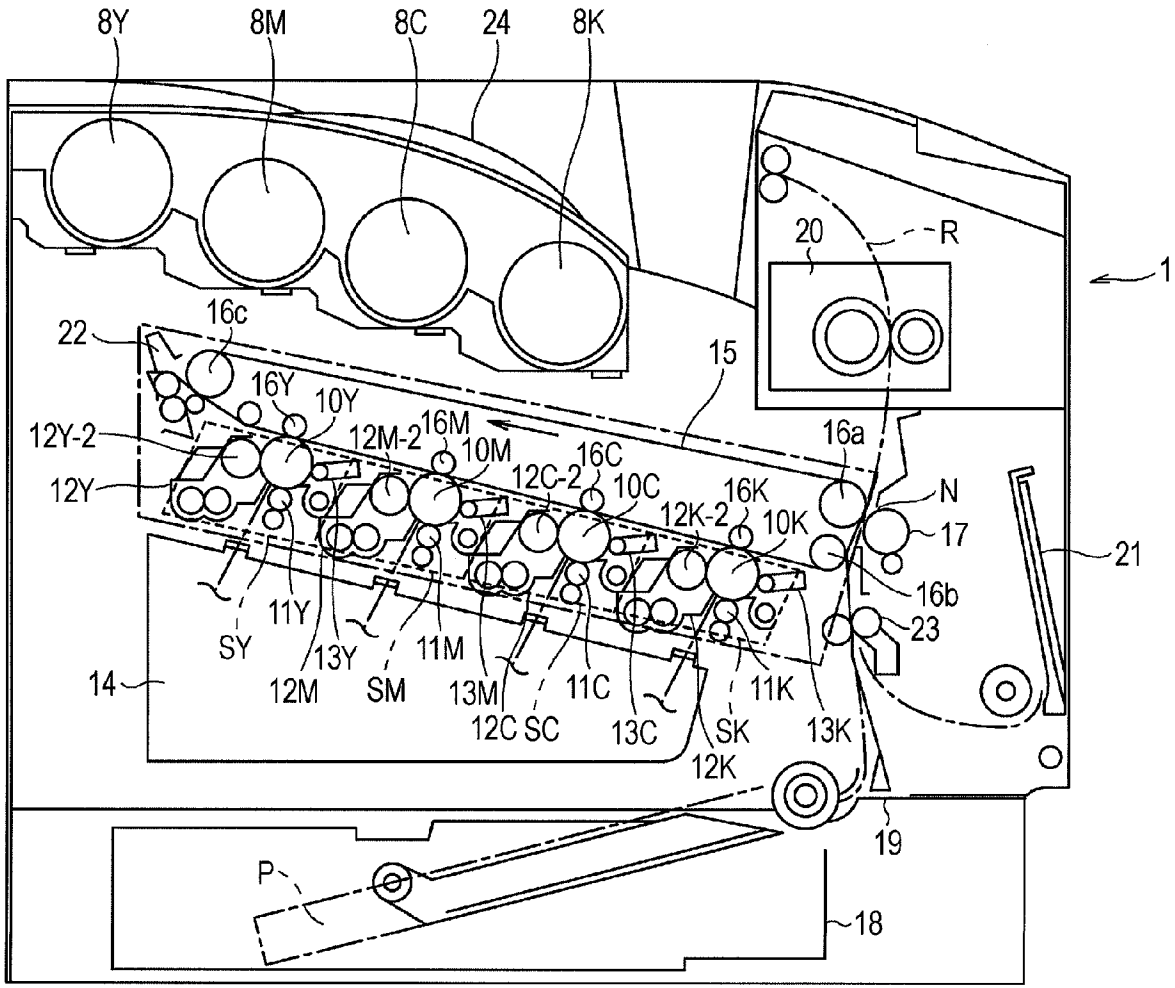
FIG. 2 is an explanatory view of the inner configuration of the printer in FIG. 1.

In FIGS. 1 and 2, the printer PR1 includes a storage section that stores printing sheets serving as recording media, a conveying mechanism for the printing sheets, and an image-forming unit that forms images on the printing sheets. A printing operation is executed by using toners of four colors including yellow (Y), magenta (M), cyan (C), and black (K) in accordance with image data that is sent from, for example, a personal computer or a scanner.

The printer PR1 includes four image-forming units SY, SM, SC, and SK (examples of image-forming member assemblies) that respectively form toner images of the colors including yellow (Y), magenta (M), cyan (C), and black (K). The image-forming units SY, SM, SC, and SK are individually attachable and detachable.

The four image-forming units SY, SM, SC, and SK have similar configurations to one another except for the colors of images formed thereby. The image-forming units SY, SM, SC, and SK include photosensitive drums 10 (10Y, 10M, 10C, 10K) (examples of photosensitive members) that are rotated at a predetermined speed; charging rollers 11 (11Y, 11M, 11C, 11K) that electrically charge the surfaces of the photosensitive drums 10Y, 10M, 10C, and 10K; developing devices 12 (12Y, 12M, 12C, 12K) that develop electrostatic latent images formed on the photosensitive drums 10Y, 10M, 10C, and 10K with toners (examples of developers) of corresponding colors; and cleaning devices 13 (13Y, 13M, 13C, 13K) that clean off toners remaining on the photosensitive drums 10Y, 10M, 10C, and 10K after transferring images.

Toner cartridges 8Y, 8M, 8C, and 8K are arranged above the image-forming units SY, SM, SC, and SK so as to be detachable and attachable. The toner cartridges 8Y, 8M, 8C, and 8K contain the toners that are used by the developing devices 12Y, 12M, 12C, and 12K for the development of the electrostatic latent images formed on the photosensitive drums 10Y, 10M, 10C, and 10K.

The developing devices 12Y, 12M, 12C, and 12K include developing rollers 12-2 (12Y-2, 12M-2, 12C-2, 12K-2) (examples of developing units) that supply the photosensitive drums 10Y, 10M, 10C, and 10K with the toners. The toners each including one component or two components and contained in the toner cartridges 8Y, 8M, 8C, and 8K are supplied to the developing rollers 12Y-2, 12M-2, 12C-2, and 12K-2 while the toners are stirred. The toners supplied to the developing rollers 12Y-2, 12M-2, 12C-2, and 12K-2 are conveyed to development regions facing the photosensitive drums 10Y, 10M, 10C, and 10K while the layer thicknesses of the toners are regulated. The toners are used to develop the electrostatic latent images formed on the surfaces of the photosensitive drums 10Y, 10M, 10C, and 10K.

Accordingly, the developing devices 12Y, 12M, 12C, and 12K develop the electrostatic latent images formed on the photosensitive drums 10Y, 10M, 10C, and 10K as toner images of the colors including yellow (Y), magenta (M), cyan (C), and black (K).

An exposure device 14 is arranged below the image-forming units SY, SM, SC, and SK. The exposure device 14 exposes the electrically charged surfaces of the photosensitive drums 10Y, 10M, 10C, and 10K to light in accordance with images of corresponding colors, and forms electrostatic latent images.

A unitized intermediate transfer belt 15 is provided between the image-forming units SY, SM, SC, and SK and the toner cartridges 8Y, 8M, 8C, and 8K. The toner images formed on the photosensitive drums 10Y, 10M, 10C, and 10K are transferred (an example of primary transferring) onto the intermediate transfer belt 15. The intermediate transfer belt 15 is in contact with the photosensitive drums 10Y, 10M, 10C, and 10K. The intermediate transfer belt 15 is detachably attached to a casing 1, and supported by three rollers 16*a*, 16*b*, and 16*c* (one of the rollers is a driving roller, and the other rollers are driven rollers). The rollers 16*a*, 16*b*, and 16*c* rotate the intermediate transfer belt 15 in a direction indicated by an arrow in FIG. 2. The toner images formed on the photosensitive drums 10Y, 10M, 10C, and 10K are superposed on top of one another and transferred onto the intermediate transfer belt 15. Thus, a full-color toner image is formed on the intermediate transfer belt 15.

A cleaner 22 is arranged at a position at which the cleaner 22 faces the roller 16*c* with the intermediate transfer belt 15 interposed therebetween. The cleaner 22 removes the toners remaining on the intermediate transfer belt 15.

Primary transfer rollers 16 (16Y, 16M, 16C, 16K) are arranged such that the primary transfer rollers 16Y, 16M, 16C, and 16K and the photosensitive drums 10Y, 10M, 10C, and 10K nip the intermediate transfer belt 15 therebetween. The primary transfer rollers 16Y, 16M, 16C, and 16K transfer the toner images formed on the photosensitive drums 10Y, 10M, 10C, and 10K onto the intermediate transfer belt 15. The primary transfer rollers 16Y, 16M, 16C, and 16K are assembled with the unitized intermediate transfer belt 15, and hence are attached and detached together with the intermediate transfer belt 15.

A secondary transfer roller 17 is provided at a position at which the secondary transfer roller 17 faces the roller 16*a* such that the secondary transfer roller 17 and the roller 16*a* define a nip portion N. The intermediate transfer belt 15 is nipped at the nip portion N. The secondary transfer roller 17 transfers the full-color toner image, which has been transferred on the intermediate transfer belt 15, onto a sheet P serving as a recording medium.

A feed cassette 18 is arranged in a lower section of the casing 1. Sheets P are stacked in the feed cassette 18. A pickup roller 19 picks up the sheets P one by one from the feed cassette 18. A picked-up sheet P is conveyed through a conveyance path R that extends from the feed cassette 18, through the nip portion N and a fixing device 20, to an ejection tray 24 that is formed above the casing 1. When the sheet P is conveyed to the nip portion N at a certain timing by a pair of registration rollers 23, the full-color toner image on the intermediate transfer belt 15 is transferred onto the sheet P by the secondary transfer roller 17. The transferred toner image is fixed by the fixing device 20. Then, the sheet P is ejected onto the ejection tray 24.

A manual feed tray 21 is provided in a side portion of the casing 1. Sheets P are also conveyed through the conveyance path R from the manual feed tray 21.

A control unit is disposed in the casing 1. The control unit is, for example, an image processing device that performs image processing on image data.

The image processing device successively outputs image data of the respective colors including yellow (Y), magenta (M), cyan (C), and black (K) to the exposure device 14. The exposure device 14 emits four laser beams in accordance with the image data, scans the photosensitive drums 10Y, 10M, 10C, and 10K, and exposes the photosensitive drums 10Y, 10M, 10C, and 10K to the beams. Hence the electrostatic latent images are formed.

Referring to FIG. 1, an outer panel 2 is provided in a side surface (a front surface in FIG. 1) of the casing 1. The outer panel 2 is manually opened and closed.

Figure 3:
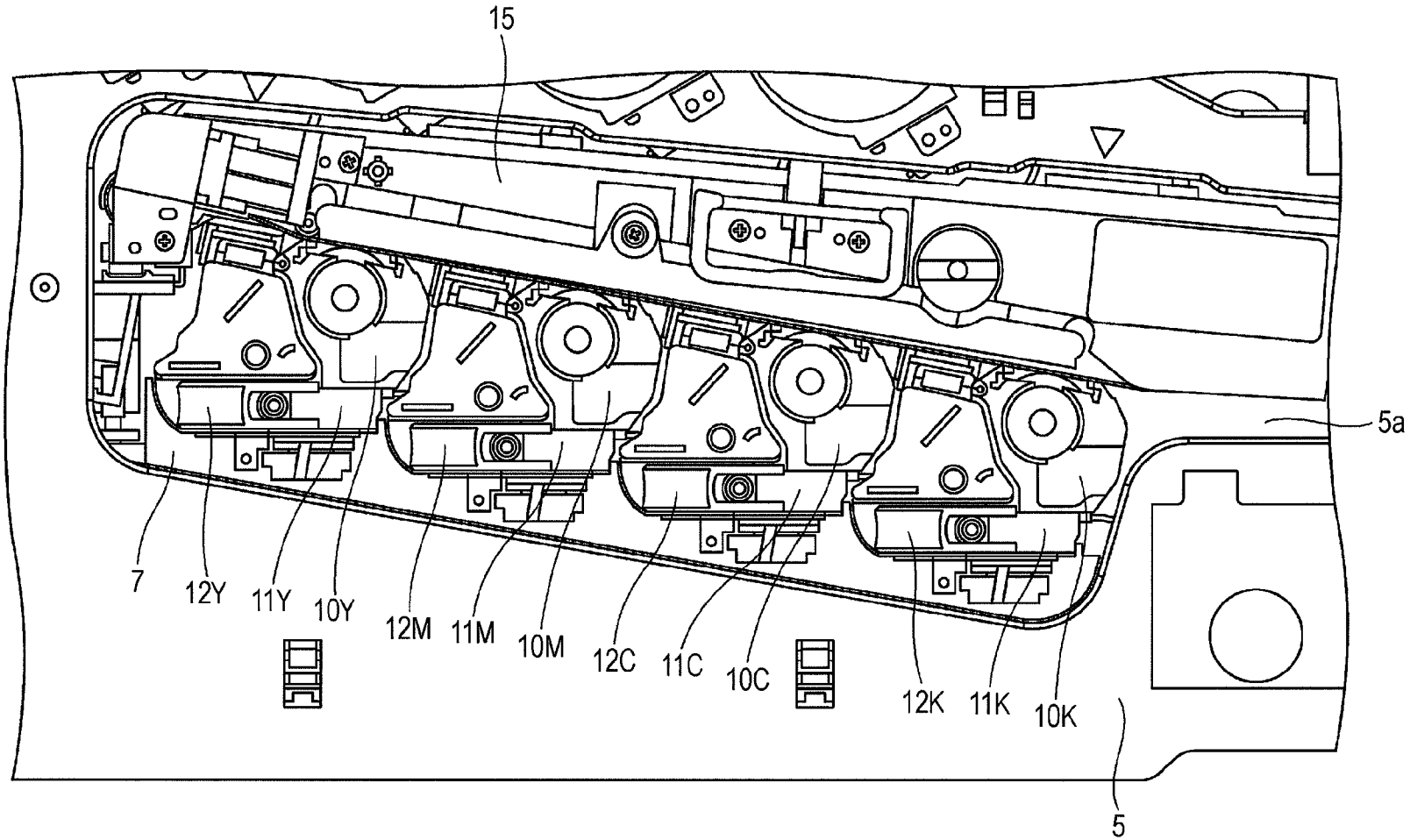
FIG. 3 illustrates the inner configuration of the printer in FIG. 1 when an outer panel and an inner panel of the printer are open.

When the outer panel 2 is open, the inner portion of the casing 1 is exposed to the outside. Referring to FIGS. 1 and 3, the unitized intermediate transfer belt 15 and the four image-forming units SY, SM, SC, and SK are mounted in the inner portion of the casing 1 so as to be attachable and detachable. In this exemplary embodiment, the mounting positions of the four image-forming units SY, SM, SC, and SK in the casing 1 are slightly different from one another in the vertical direction. The image-forming unit SY is mounted at the highest position. The mounting positions of the image-forming units SM, SC, and SK are progressively lower in that order.

Referring to FIG. 1, the intermediate transfer belt 15, and the image-forming units SY, SM, SC, and SK are covered with an inner panel 3. The inner panel 3 is attached to an inner wall 5 that has an opening 5*a*, through which the intermediate transfer belt 15 and the image-forming units SY, SM, SC, and SK are attached and detached. The inner panel 3 is opened and closed while a lower portion thereof serves as a support point. The inner panel 3 closes the opening 5*a* when the inner panel 3 is closed.

Referring to FIG. 1, two release levers 4 are provided on the inner panel 3. Each release lever 4 is moved between a position at which the closed inner panel 3 is locked relative to the inner wall 5 and a position at which the closed inner panel 3 is unlocked relative to the inner wall 5.

Figure 4:
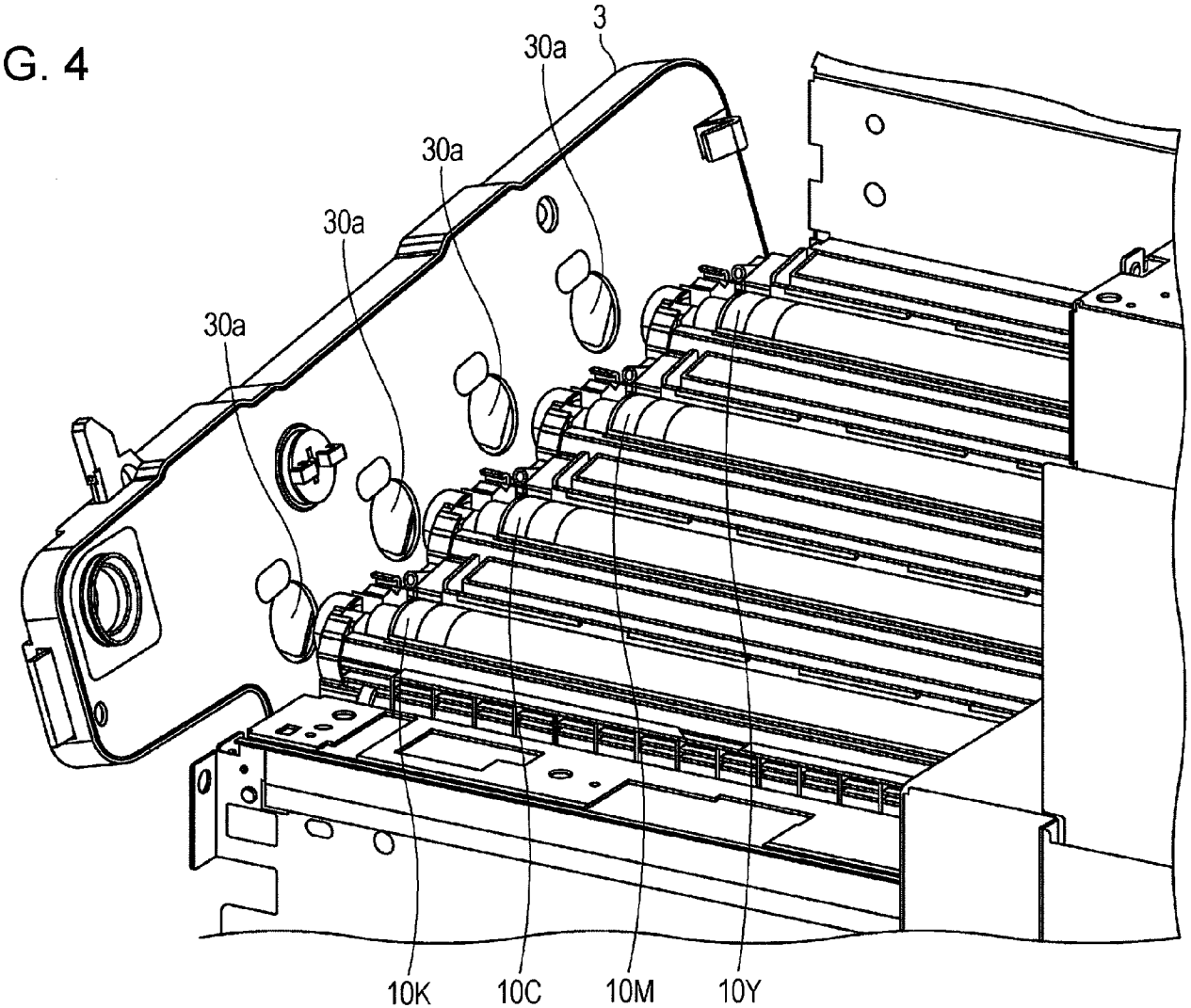
FIG. 4 is a perspective view illustrating the relationship between a photosensitive drum and the inner panel of the printer in FIG. 1.

Referring to FIG. 4, the photosensitive drums 10Y, 10M, 10C, and 10K, the charging rollers 11Y, 11M, 11C, and 11K, the developing devices 12Y, 12M, 12C, and 12K, and the primary transfer rollers 16Y, 16M, 16C, and 16K are arranged such that the longitudinal direction of these components are aligned with the mounting direction of these components. In addition, transmission mechanisms (for example, gears and couplings) that transmit torques to the photosensitive drums 10Y, 10M, 10C, and 10K, the charging rollers 11Y, 11M, 11C, and 11K, the developing devices 12Y, 12M, 12C, and 12K, and the primary transfer rollers 16Y, 16M, 16C, and 16K are arranged at positions on the forward side in the mounting direction of the image-forming units SY, SM, SC, and SK (that is, the far side of the casing 1). In this exemplary embodiment, the photosensitive drums 10Y, 10M, 10C, and 10K are driven by using the couplings. Thus, the rotating shafts of the photosensitive drums 10Y, 10M, 10C, and 10K are prevented from being displaced when the photosensitive drums 10Y, 10M, 10C, and 10K are driven.

Figure 5:
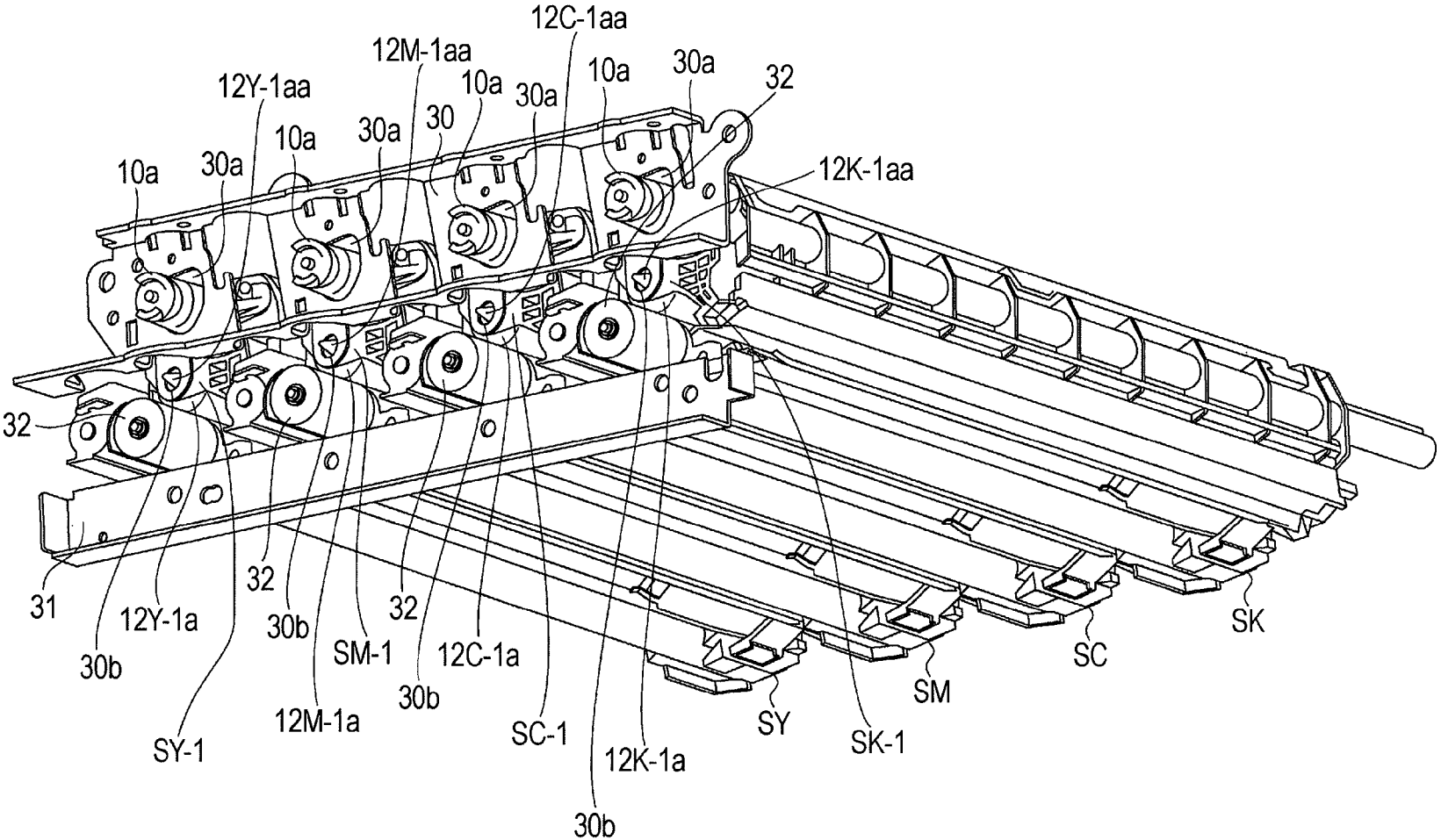
FIG. 5 is a perspective view showing an image-forming unit and a bracket of the printer in FIG. 1.
Figure 6:
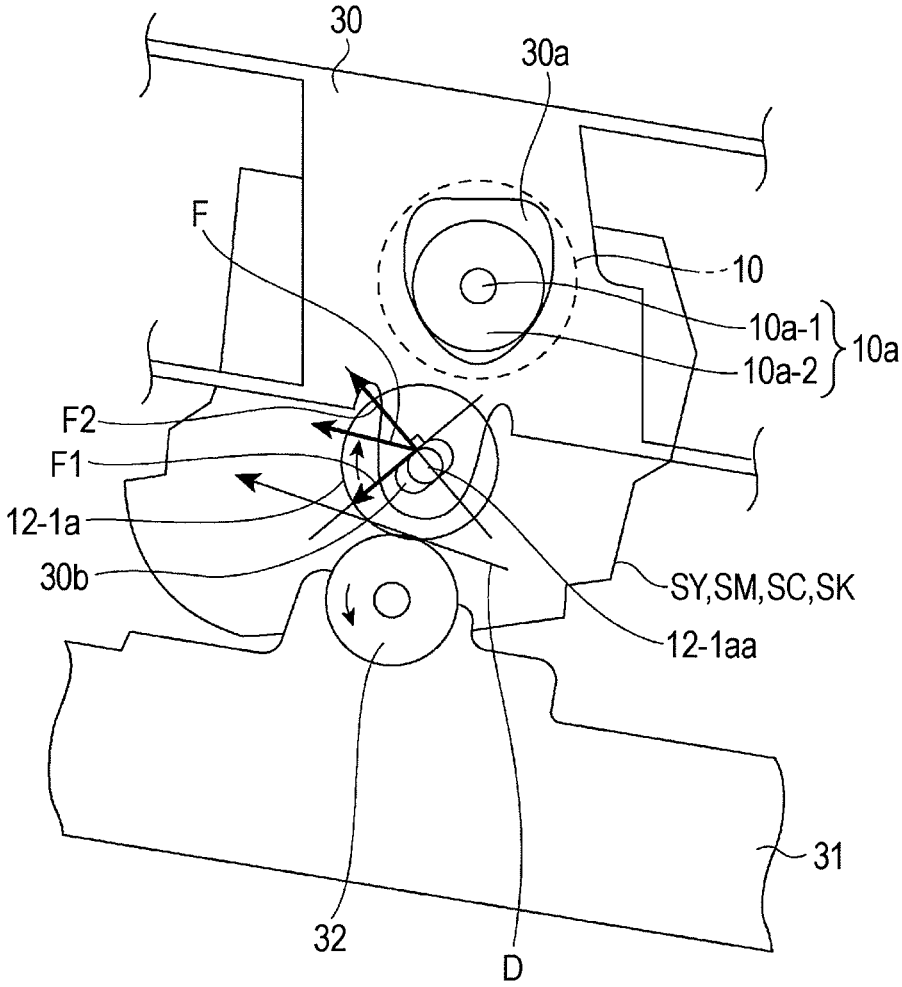
FIG. 6 illustrates the relationship between the image-forming unit and the bracket.

Idler gears 12-1*a* (12Y-1*a*, 12M-1*a*, 12C-1*a*, 12K-1*a*) (examples of rotating units) are arranged at positions on the backward side in the mounting direction of the image-forming units SY, SM, SC, and SK (that is, the near side of the casing 1) (see FIGS. 5 and 6). The idler gears 12Y-1*a*, 12M-1*a*, 12C-1*a*, 12K-1*a* transmit driving forces to developing-roller-rotating gears that rotate the developing rollers 12Y-1, 12M-1, 12C-1, and 12K-1.

Referring to FIGS. 4 and 5, the inner panel 3 includes a bracket 30 (an example of a positioning member) having positioning holes 30*a* (examples of positioning holes). The positioning holes 30*a* rotatably support the shafts 10*a* of the photosensitive drums 10Y, 10M, 10C, and 10K. Each of the positioning holes 30*a* has a V-shaped lower portion to allow the shaft 10*a* to contact the positioning hole 30*a* at two points for positioning. The release levers 4 provided on the inner panel 3 include spring members (not shown). When the release levers 4 are operated to be moved to the positions at which the inner panel 3 is locked to the inner wall 5, the spring members press the shafts 10*a* of the photosensitive drums 10Y, 10M, 10C, and 10K against edges of the positioning holes 30*a* in association with the operation. When the release levers 4 are operated, each of the shafts 10*a* of the photosensitive drums 10Y, 10M, 10C, and 10K is pressed to the corresponding positioning hole 30*a* at the two points for positioning.

The shafts 10*a* of the photosensitive drums 10Y, 10M, 10C, and 10K each include a rotating shaft 10*a*-1 that rotates with the drum body and a bearing 10*a*-2 that rotatably supports the rotating shaft 10*a*-1. The shaft 10*a*-2 does not rotate but is merely supported by the positioning hole 30*a*. The rotating shaft 10*a*-1 supported by the bearing 10*a*-2 rotates.

Figure 11:
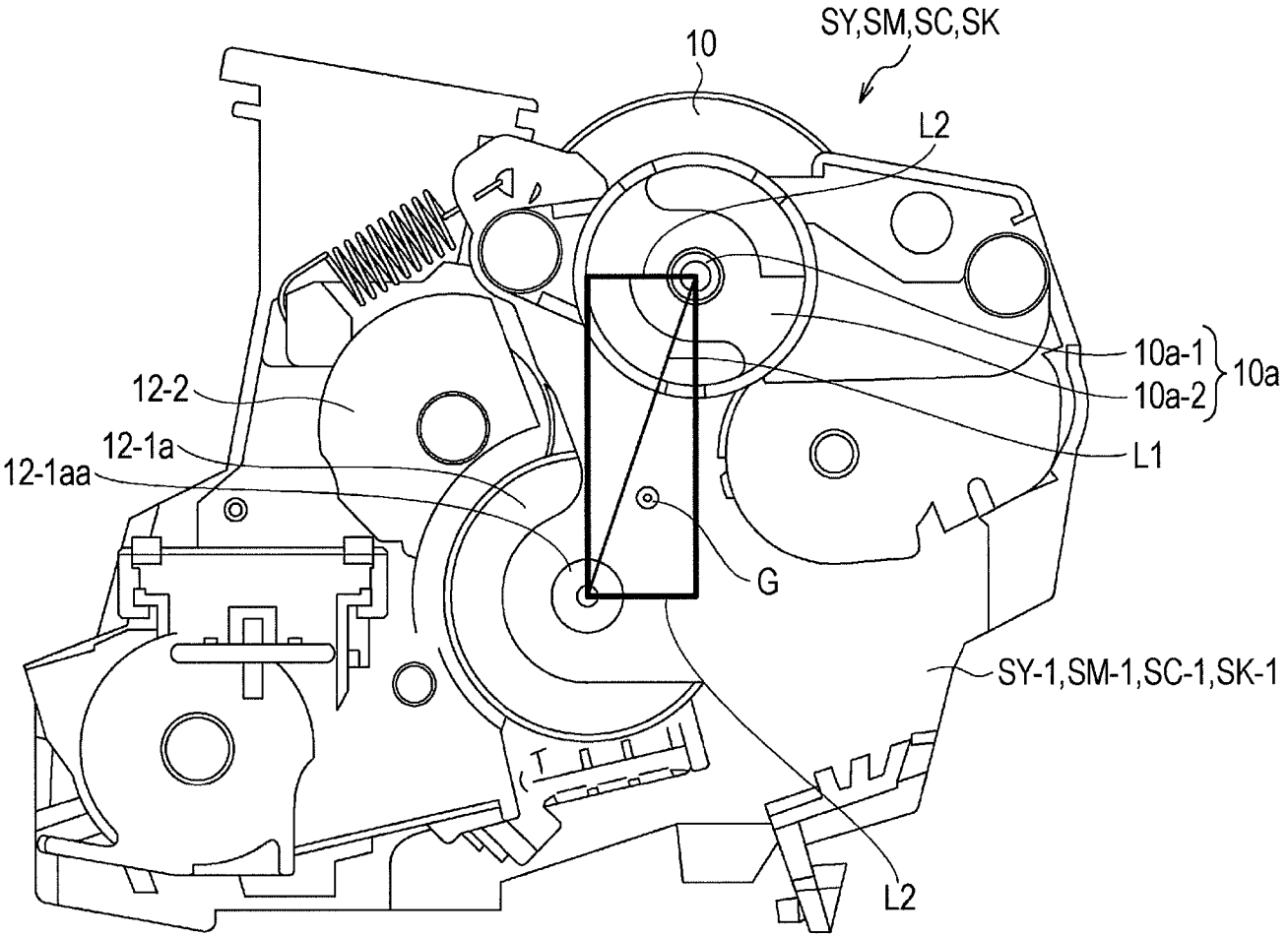
FIG. 11 is a side view showing the image-forming unit of the printer in FIG. 1.

The shafts 10*a* of the photosensitive drums 10 and the idler gears 12-1*a* are supported by support frames SY-1, SM-1, SC-1, and SK-1 that are attached at positions on the backward side in the mounting direction of the image-forming units SY, SM, SC, and SK (see FIG. 11).

The lower portions of the positioning holes 30*a* of the photosensitive drums 10Y, 10M, 10C, and 10K do not have to have V shapes, and the lower portions may have any shapes as long as the photosensitive drums 10Y, 10M, 10C, and 10K can be positioned.

Referring to FIGS. 5 and 6, the bracket 30 (an example of a support member) also has support holes 30*b* (examples of support holes) that support rotating shafts 12-1*aa* (12Y-1*aa*, 12M-1*aa*, 12C-1*aa*, 12K-1*aa*) of the idler gears 12-1*a* (12Y-1*a*, 12M-1*a*, 12C-1*a*, 12K-1*a*).

The support holes 30*b* are long holes that are elongated toward the positioning holes 30*a*. Since the rotating shafts 12-1*aa* are supported by the support holes 30*b*, the idler gears 12-1*a* can be moved toward and away from the positioning holes 30*a*.

Transmission gears 32 are rotatably attached to a body frame 31. The transmission gears 32 transmit torques from drive sources (examples of driving units, not shown) to the idler gears 12-1*a*. The idler gears 12-1*a* mesh with the drive sources through the transmission gears 32. When the drive sources rotate the transmission gears 32, the torques are transmitted to the idler gears 12-1*a* and the idler gears 12-1*a* are rotated. The developing rollers 12-2 are rotated accordingly, and the developing rollers 12-2 supply the photosensitive drums 10 with the toners.

Referring to FIG. 6, a direction, in which the idler gears 12-1*a* are driven by the torques when the idler gears 12-1*a* receive the torques from the transmission gears 32, is a pressure angle acting direction D. In this exemplary embodiment, forces F received by the rotating shafts 12-1*aa* at the support holes 30*b* when the idler gears 12-1*a* are rotated by forces in the pressure angle acting direction D will be described below.

Figure 7:
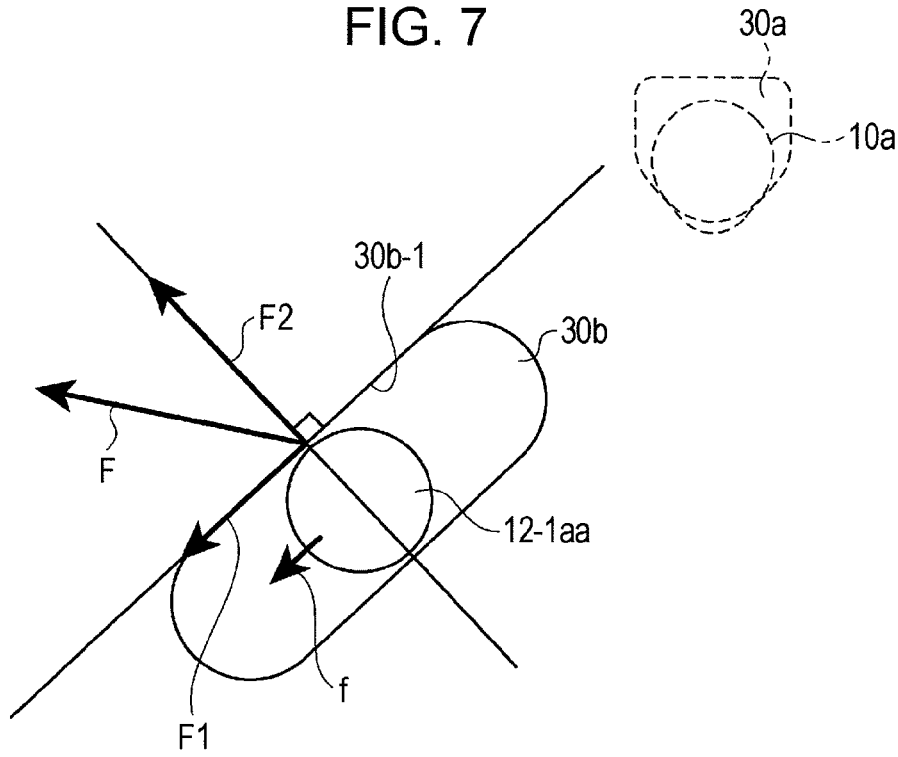
FIG. 7 explains the force that a rotating shaft of an idler gear receives at a support hole.
Figure 8:
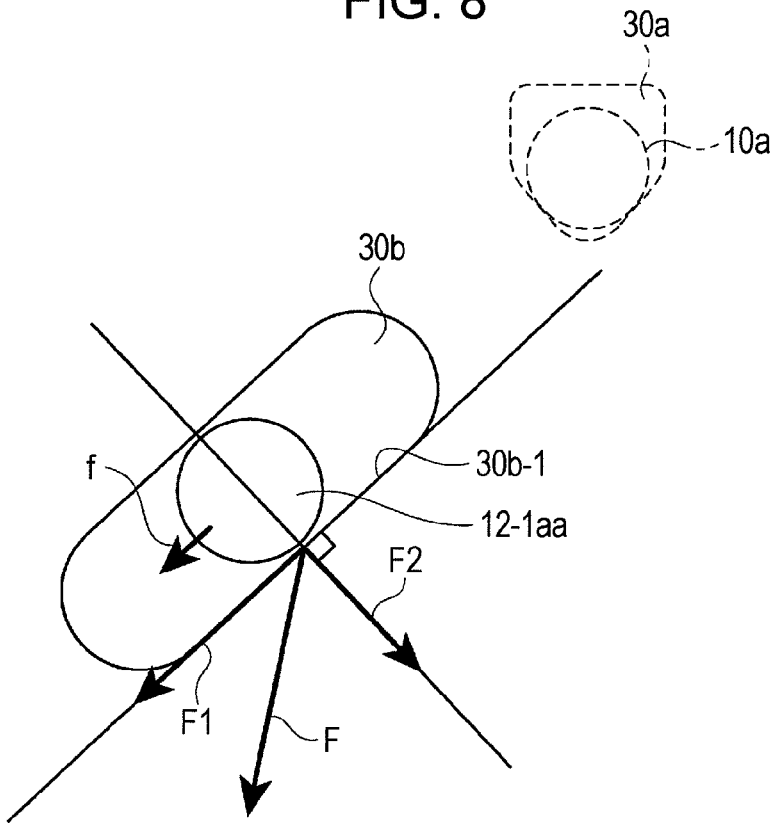
FIG. 8 explains the force that the rotating shaft of the idler gear receives at the support hole.

Referring to FIGS. 7 to 10, a guide side 30*b*-1 defines a side of each of the support holes 30*b*. The guide side 30*b*-1 guides the movement of the corresponding rotating shaft 12-1*aa* in the support hole 30*b*. When the force F is divided into a first component force F1 along the guide side 30*b*-1 and a second component force F2 orthogonal to the guide side 30*b*-1, in this exemplary embodiment, the direction of the first component force F1 is a direction in which the contact force of the shaft 10*a* of the photosensitive drum 10 against the edge of the positioning hole 30*a* is increased, as shown in FIGS. 7 and 8.

When the direction of the first component F1 is the direction in which the contact force of the shaft 10*a* of the photosensitive drum 10 against the edge of the positioning hole 30*a* is increased, a force f acts in a direction in which the rotating shaft 12-1*aa* of the idler gear 12-1*a* is moved away from the positioning hole 30*a* during the operation of the apparatus as shown in FIGS. 7 and 8. When the idler gear 12-1*a* is rotated, a force in the direction in which the image-forming unit SY, SM, SC, or SK is moved away from the positioning hole 30*a* is not exerted on the image-forming unit SY, SM, SC, or SK, to which the idler gear 12-1*a* is attached.

Figure 9:
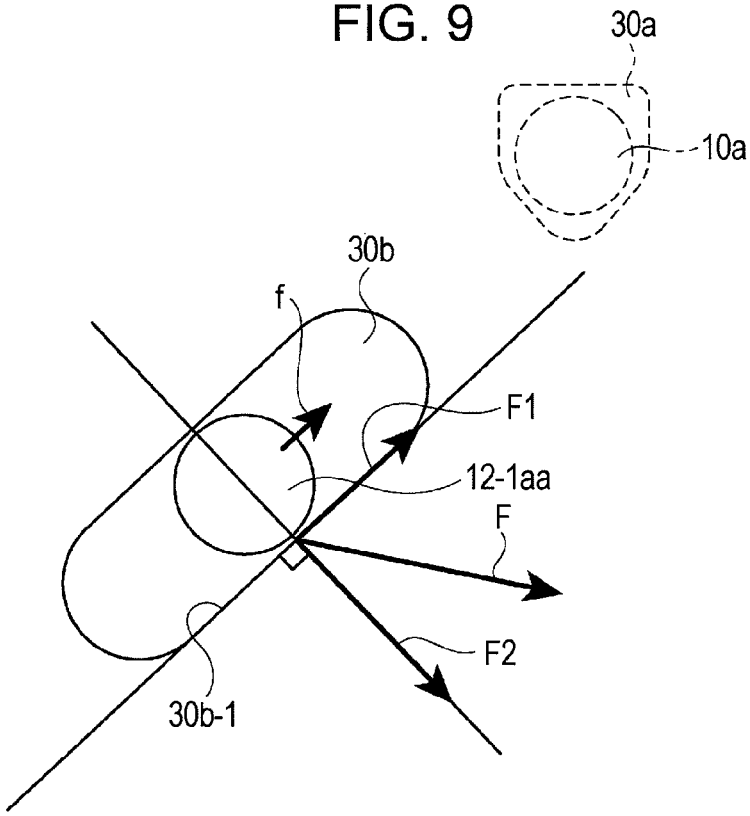
FIG. 9 explains the force that the rotating shaft of the idler gear receives at the support hole.
Figure 10:
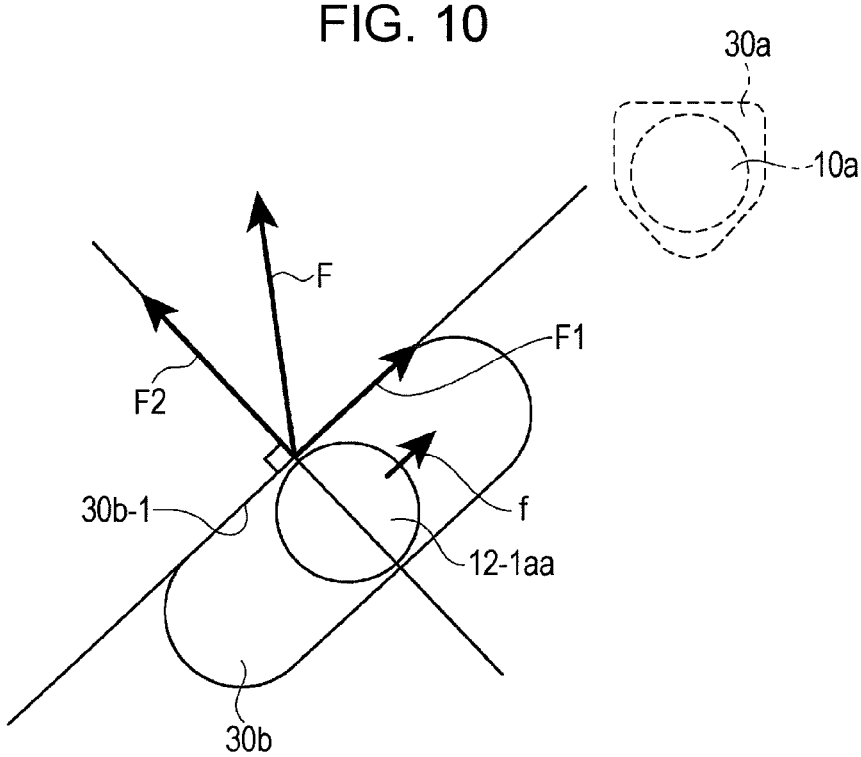
FIG. 10 explains the force that the rotating shaft of the idler gear receives at the support hole.

In contrast, referring to FIGS. 9 and 10, if the direction of the first component F1 is a direction in which the contact force of the shaft 10*a* of the photosensitive drum 10 against the edge of the positioning hole 30*a* is decreased, for example, although a force F is exerted toward the lower side as shown in FIG. 9, a force f toward the positioning hole 30*a* acts on the rotating shaft 12-1*aa* of the idler gear 12-1*a* during the operation of the apparatus. Then, when the idler gear 12-1*a* is rotated, a force in the direction in which the image-forming unit SY, SM, SC, or SK is moved away from the positioning hole 30*a* is exerted on the image-forming unit SY, SM, SC, or SK, and hence the shaft 10*a* of the photosensitive drum 10 may be lifted from the positioning hole 30*a*.

In this exemplary embodiment, as described above, the force in the direction in which the image-forming unit SY, SM, SC, or SK is moved away from the positioning hole 30*a* is not exerted on the image-forming unit SY, SM, SC, or SK. The shaft 10*a* of the photosensitive drum 10 is not lifted from the positioning hole 30*a* and is reliably positioned with respect to the positioning hole 30*a*. Accordingly, color misregistration and banding failure due to variation in the position of the photosensitive drum 10 can be prevented.

Since a force that lifts the shaft 10*a* of the photosensitive drum 10 is not exerted, the spring force that causes the shaft 10*a* of the photosensitive drum 10 to be pressed against the edge of the positioning hole 30*a* is decreased. The image-forming unit SY, SM, SC, or SK can be detached from the apparatus body by a small operating force.

Referring to FIG. 11, the center of gravity G of the image-forming unit SY, SM, SC, or SK may be located within a rectangular or square region, or a substantially rectangular or square region defined by a segment L1 serving as a diagonal that connects the shaft 10*a* of the photosensitive drum 10 and the rotating shaft 12-1*aa* of the idler gear 12-1*a*, and by horizontal lines L2 passing through both ends of the segment L1. Since the center of gravity G is located within that region, a force in the direction in which the image-forming unit SY, SM, SC, or SK is moved away from the positioning hole 30*a* during the operation of the apparatus is further reliably prevented from being exerted on the image-forming unit SY, SM, SC, or SK.

The exemplary embodiment of the invention made by the inventor has been specifically described above, however, all components and techniques of the exemplary embodiment disclosed in the specification are merely examples, and hence it is to be noted that the invention is not limited to the disclosed components and techniques. In particular, the technical scope of the present invention should not be interpreted in a limited manner on the basis of the explanation in the exemplary embodiment, but should be interpreted on the basis of the scope of the claims. The present invention includes all modifications without departing from techniques equivalent to the techniques described in the scope of the claims and the concept of the scope of the claims.

For example, in this exemplary embodiment, the bracket 30 has the positioning hole 30*a* and the support hole 30*b*. However, the bracket 30 may be divided into a positioning member having the positioning hole 30*a* and a support member having the support hole 30*b*.

If the bracket 30 has the positioning hole 30*a* and the support hole 30*b* like in the exemplary embodiment, the shaft 10*a* of the photosensitive drum 10 and the rotating shaft 12-1*aa* of the idler gear 12-1*a* are accurately positioned. A force in the direction in which the image-forming unit SY, SM, SC, or SK is moved away from the positioning hole 30*a* during the operation of the apparatus is further reliably prevented from being exerted on the image-forming unit SY, SM, SC, or SK.

Figure 12:
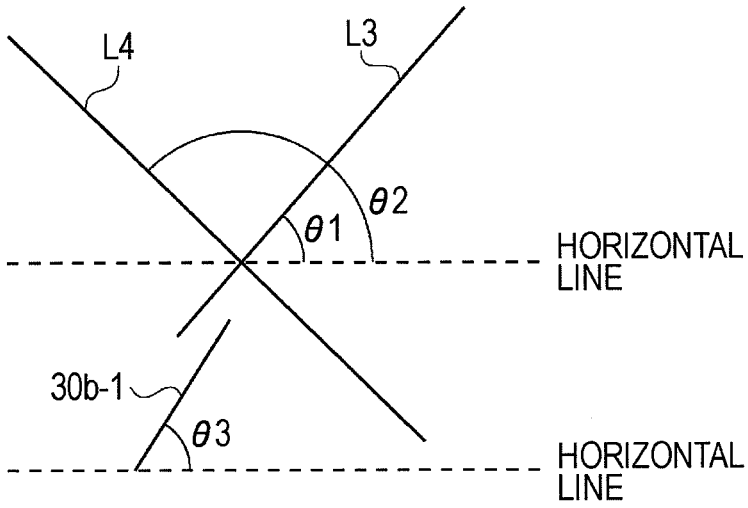
FIG. 12 explains the relationship between tangents of the support hole respectively passing through two points at which a shaft of the photosensitive drum contacts a positioning hole and a guide side of the support hole.

Also, referring to FIG. 12, when θ1 and θ2 are angles respectively defined by a tangent L3 and the horizontal line and by a tangent L4 and the horizontal line (θ1<θ2), the tangents L3 and L4 passing through the two points at which the shaft 10*a* of the photosensitive drum 10 contacts the positioning hole 30*a*; and θ3 is an angle defined by the guide side 30*b*-1 of the support hole 30*b* and the horizontal line, the angles may be set such that the angle θ3 is equal to or greater than the angle θ1 and is equal to or smaller than the angle θ2 (θ1≦θ3≦θ2).

Accordingly, the shaft 10*a* of the photosensitive drum 10 reliably contacts the positioning hole 30*a* at the two points. A force in the direction in which the image-forming unit SY, SM, SC, or SK is moved away from the positioning hole 30*a* is further reliably prevented from being exerted on the image-forming unit SY, SM, SC, or SK.

In the above description, the printer serving as the image-forming apparatus is a full-color printer. However, the printer may be a color printer that is not a full-color printer, or may be a black and white printer.

Also, the image-forming apparatus may be, for example, a facsimile machine. Further, the image-forming apparatus may have plural functions including a function of a printer and a function of a facsimile machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an image-forming member assembly including a photosensitive member that has a shaft and allows an electrostatic latent image to be formed thereon, a developing unit that supplies the photosensitive member with a developer and develops the electrostatic latent image, and a rotating unit that has a rotating shaft, receives a driving force, and rotates the developing unit;

a driving unit that drives the rotating unit;

a positioning member having a positioning hole in which the shaft of the photosensitive member is rotatably supported and positioned at two points; and a support member having a support hole that has a guide side to guide the movement of the rotating shaft and supports the rotating shaft of the rotating unit in a direction in which the rotating shaft is moved toward and away from the positioning hole, wherein when the rotating shaft moves away from the positioning hole, the shaft of the photosensitive member is pressed against the positioning hole.

2. The image-forming apparatus according to claim 1, wherein a center of gravity of the image-forming member assembly is located within a substantially rectangular or square region defined by a segment serving as a diagonal that connects the shaft of the photosensitive member and the rotating shaft of the rotating unit, and by horizontal lines passing through both ends of the segment.

3. The image-forming apparatus according to claim 1, wherein the image-forming apparatus satisfies inequality conditions

θ1≦θ3

θ3≦θ2,

θ1≠θ2 where θ1 denotes an angle defined by a horizontal line and a tangent, at which the shaft of the photosensitive member contacts the positioning hole, θ2 denotes another angle defined by the horizontal line and another tangent, at which the shaft of the photosensitive member contacts the positioning hole, and θ3 denotes an angle defined by the horizontal line and the guide side of the support hole.

4. The image-forming apparatus according to claim 1, wherein the positioning member and the support member are integrally formed.

5. The image-forming apparatus according to claim 1, the support hole is an elongated hole that has the guide side to obstruct the movement of the rotating shaft in a minor axis direction of the elongated hole, the rotating shaft is slidable in a major axis direction of the elongated hole.

6. The image-forming apparatus according to claim 1, wherein the support hole is an elongated hole having a major axis and a minor axis, and when a force received by the rotating shaft while the driving unit drives the rotating unit is divided into a first component force along a direction of the major axis and a second component force along a direction of the minor axis, the first component force presses the shaft of the photosensitive member against the positioning hole.

7. The image-forming apparatus according to claim 6, wherein the support hole limits movement of the rotating shaft in the direction of the minor axis.

8. An image forming apparatus comprising:

an image forming member assembly including a photosensitive member that has a shaft and allows an electrostatic latent image to be formed thereon, a developing unit that supplies the photosensitive member with a developer and develops the electrostatic latent image, and a rotating unit that has a rotating shaft, receives a driving force, and rotates the developing unit;

a driving unit that drives the rotating unit; and a bracket having a positioning portion in which the shaft of the photosensitive member is rotatably supported and positioned at two points, and an elongated hole that has a guide side that prevents movement of the rotating shaft in a direction of a minor axis of the elongated hole, the rotating shaft is slidable in a direction of major axis of the elongated hole, wherein when the rotating shaft moves away from the positioning hole, the shaft of the photosensitive member is pressed against the positioning hole.

9. The image forming apparatus according to claim 8, wherein the center of gravity of the image forming member assembly is located within a substantially rectangular or square region defined by a segment serving as a diagonal that connects the shaft of the photosensitive member and the rotating shaft of the rotating unit, and by horizontal lines passing through both ends of the segment.

10. The image forming apparatus according to claim 8, wherein the image-forming apparatus satisfies inequality conditions $\theta 1 \leqq \theta 3$ $\theta 3 \leqq \theta 2$, $\theta 1 \neq \theta 2$ where $\theta 1$ denotes an angle defined by a horizontal line and a tangent, at which the shaft of the photosensitive member contacts the positioning hole, $\theta 2$ denotes another angle defined by the horizontal line and another tangent, at which the shaft of the photosensitive member contacts the positioning hole, and $\theta 3$ denotes an angle defined by the horizontal line and the guide side of the support hole.

11. The image-forming apparatus according to claim 8, wherein when a force received by the rotating shaft while the driving unit drives the rotating unit is divided into a first component force along the major axis direction and a second component force along the minor axis direction, the first component force has a direction in which the shaft of the photosensitive member is pressed against the positioning hole.

* * * * *